US008900075B2

(12) United States Patent
Gu

(10) Patent No.: US 8,900,075 B2
(45) Date of Patent: Dec. 2, 2014

(54) METHOD AND APPARATUS FOR HITTING A BALL

(76) Inventor: Fan Gu, Houston, TX (US)

( * ) Notice: Subject to any disclaimer, the term of this patent is extended or adjusted under 35 U.S.C. 154(b) by 0 days.

(21) Appl. No.: 12/932,903

(22) Filed: Mar. 9, 2011

(65) Prior Publication Data

US 2011/0165969 A1 Jul. 7, 2011

Related U.S. Application Data

(63) Continuation-in-part of application No. 12/454,887, filed on May 26, 2009, now abandoned.

(51) Int. Cl.
*A63B 69/00* (2006.01)

(52) U.S. Cl.
USPC ..... 473/423; 473/422; 473/458; 473/450; 473/451

(58) Field of Classification Search
USPC ..... 473/422, 423–430, 417, 451, 419
See application file for complete search history.

(56) References Cited

U.S. PATENT DOCUMENTS

| | | | | | |
|---|---|---|---|---|---|
| 2,272,765 | A * | 2/1942 | Beeson et al. | ..... | 473/417 |
| 2,506,825 | A * | 5/1950 | Carlson | ..... | 473/429 |
| 3,183,000 | A * | 5/1965 | Dix | ..... | 473/417 |
| 4,706,964 | A * | 11/1987 | Genovese | ..... | 473/575 |
| 5,467,978 | A * | 11/1995 | Paluch | ..... | 473/429 |
| 5,540,430 | A * | 7/1996 | Nichols et al. | ..... | 473/418 |
| 6,086,488 | A * | 7/2000 | Sanders | ..... | 473/423 |
| 6,099,419 | A * | 8/2000 | Incaudo et al. | ..... | 473/429 |
| 6,334,821 | B1 * | 1/2002 | Kita | ..... | 473/430 |
| 6,688,994 | B2 * | 2/2004 | Matulek et al. | ..... | 473/429 |
| 6,790,150 | B1 * | 9/2004 | Moss et al. | ..... | 473/430 |
| 7,115,051 | B2 * | 10/2006 | Hansberry | ..... | 473/423 |
| 7,186,193 | B1 * | 3/2007 | McFadden, Jr. | ..... | 473/459 |
| 7,226,373 | B2 * | 6/2007 | Arenas | ..... | 473/417 |
| 7,775,913 | B2 * | 8/2010 | Woods | ..... | 473/430 |
| 2009/0082140 | A1 * | 3/2009 | Liao | ..... | 473/417 |
| 2010/0009783 | A1 * | 1/2010 | Bozarth | ..... | 473/419 |

* cited by examiner

*Primary Examiner* — Mitra Aryanpour

(57) ABSTRACT

A hitting apparatus is provided, including a supporting unit, at least a linking unit, and an attaching device. The apparatus includes foldable supporting legs, an adjustable supporting rod, an adjustable hanging arm, an adjustable extension arm, connection elements, attaching elements and attaching ball. The adjustable extension arm is flexible, which can be adjusted at any direction by hand, or foreign force. The connections between connection elements are detachable and releasable upon hit by bat or other subjects. The hanging arm is engaged to the top of supporting rod, and adjustable in length and angles and easy to be detached from the support rod to become a hand held hitting training apparatus. The attaching parts of hook/loop, magnets, adhesive or rubbers holding the ball with minimum detaching releasable force required, The present invention can enhance the focus of the batter on the ball and have a clear hit on the ball.

7 Claims, 12 Drawing Sheets

METHOD AND APPARATUS FOR HITTING A BALL

CROSS REFERENCE TO RELATED APPLICATION

This application is continuation-in-part of application Ser. No. 12/454,887 filed on May 26, 2009 now abandoned.

BACKGROUND OF THE INVENTION

1. Field of the Invention

The present invention generally relates to a hitting apparatus, and more specifically to an apparatus using hook and loop, magnet or adhesive to hold the ball for hitting practice.

2. Brief Description of the Prior Art

Devices for aiding in the training of a ball hitting swing are generally known in the art. There are a variety of batting apparatus for batting practice. The conventional batting apparatus is usually designed as a vertically standing position. For example, U.S. Pat. No. 4,176,838 discloses a batting baseball tee. U.S. Pat. No. 5,672,124 discloses an automatic batting tee apparatus. U.S. Pat. No. 6,413,175 discloses a batting tee with brush fiber holding and a swing guide. U.S. Pat. No. 6,682,445 discloses a durable batting tee with rubber holding material.

These types of batting apparatus only provide some degree of batting practice. Although the practice may be useful in some aspects, the hitting is not freely. When ball is hit, the angle of the hitting, resistance between the ball and ball holder will affect the spin and trajectory of the ball. It is not very easy for batter to get a clear hit without the bat touching any parts of the holder. This will reduce the hitting strength on the ball. It is also very difficulty for batter to hit the ball in right angle and make it fly out from batting apparatus in right spinning and angle.

U.S. Pat. No. 6,790,150 discloses a ball hitting practice apparatus, which is capable of consistently delivering a ball through the same or similar moving path to simulate a number of different types of pitches. It includes a special design releasable ball mounting assembly comprises two complementary halves which fixed to tubular member and ball respectively by a hook and loop type fastener. The attaching force of this special tubular member fixture would be much higher than the weight of ball to prevent ball falling from hook during ball mounting device moving before batter hitting the ball. Its ball mounting assembly could not be releasable from support member which could affect batting's swing in case of batting miss of hitting ball while hit on any part of the ball mounting assembly or rigid member above. It can be considered as a toss/pitching training apparatus.

US2009/0082140A1 shows a hitting apparatus comprising a support unit including foldable support legs, an adjust support rod, an adjustable hanging arm, a connecting element string and an attaching element suction disk which can hold ball temporarily for about 5-10 seconds. This is not very practical and useful for batting practice. The connection element is not releasable in case of hitting by bat. It can be considered as a drop ball hitting training apparatus.

Therefore, the present invention provides a hitting apparatus to enable the batter to practice hitting the ball almost freely in various manners such as hitting angle and ball spinning to improve the hitting skills and strength. The swing bat will not touch the attaching part and detaching force between attaching part and ball will be minimum as weight of the balls.

Batter will focus on hitting ball in full strength not worry about to hit the attaching parts.

SUMMARY OF THE INVENTION

The present invention generally relates to a hitting apparatus, and more specifically to an apparatus using adjustable and flexible extension arm, and hitting releasable attaching parts such as hook/loop, magnets or adhesive to hold the ball for hitting practice.

The main object of the present invention is to provide batter a hitting apparatus using a hook/loop, magnet or adhesive including pressure sensitive adhesive or Gecko like adhesive (rubber material) hanging a ball with minimum detaching force as comparing of weight of ball. To hanging the ball, a small area of loops (prefer) or hook or magnet metal part need to be attached to the ball by pressure sensitive adhesive or metal coating, the attaching part on ball could be removable and replaceable. The contact area can be adjustable and can be as small as 0.2 $in^2$ with different shape. The ball with the loops or metal tape or coating will have minimum effect on the ball handling feeling and ball trajectory and spinning after hitting by bat. The hitting is almost freely comparing with conventional batting apparatus.

Another object of the present invention is to provide a hitting apparatus to enhance the focus of the batter on ball without worrying about hitting the ball connection parts such as string as prior art. The adjustable extension arm is an addition and unique part comparing those regular hanging arm in prior arts. It is made from the flexible tube with gooseneck structure. It can be adjusted in 360 degree by one touch. When bat struck on it, it can change position and relax the impact force so the batting apparatus would not be knocked off. The attaching parts are connected with adhesive, magnet or loop/hook, which can be detached and released when bat or other force hit them. Without worrying hitting the connection string resulting tangling the bat and pull down the apparatus or hurt someone, batter can use full strength and hit the ball right angle and pull the ball in proper directions.

Another object of the present invention is to provide a hitting apparatus for batter easy assemble, adjust, use, carry around and store. The apparatus includes foldable supporting legs with a screw can adjust height, a supporting rod with length adjustment, a hanging adjustable arm, an adjustable extension arm for 360 degree free adjustment, few attaching rods, string with connection from hook/loop, adhesive or magnets. The hanging arm is engaged to the top of the supporting rod, and adjustable in length and angles and easy to detach from the support rod to become a hand held hitting training apparatus when a trainer can hold the hanging arm with adjustable extension arm for batter to hit the ball. To provide better conditions and features of batting apparatus, a standard ¼"-20 or ⅜"-16 screw is placed on top of the support rod. It is can be used to attach other devices such as camera, speed gun or lighting element.

Foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in accompanying drawings, wherein.

DETAILED DESCRIPTION OF THE DRAWINGS

Figure 1:
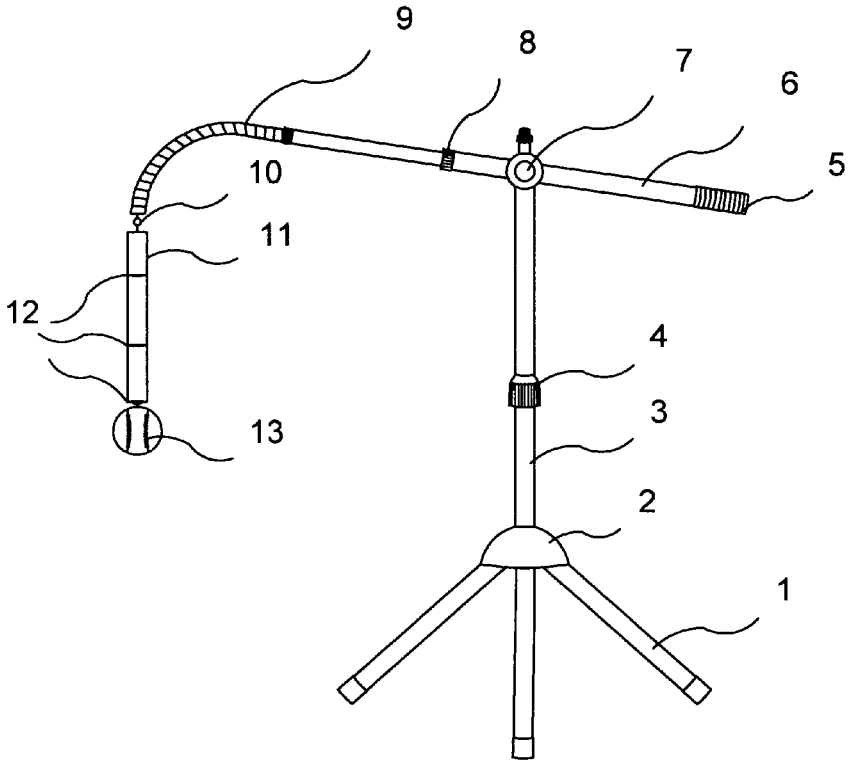
FIG. 1 shows a schematic view of the first embodiment of the present invention.
Figure 1A:
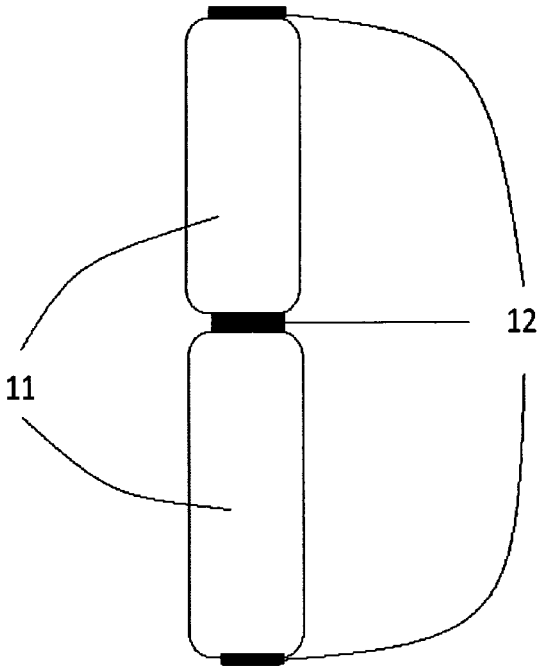
Figure 1B:
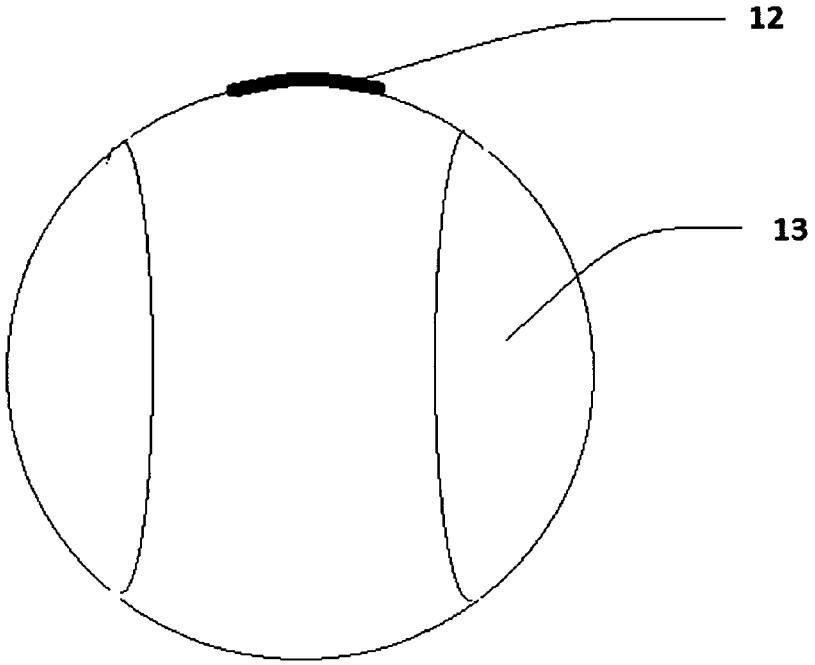

FIG. 1 shows a schematic view of the present invention. A batting apparatus of the present invention includes a supporting leg 1, base 2, support rod 3, hanging arm 6, extension arm 9, attaching rods 11, and attaching ball hook, magnets or adhesive 12 and ball 13.

Figure 3:
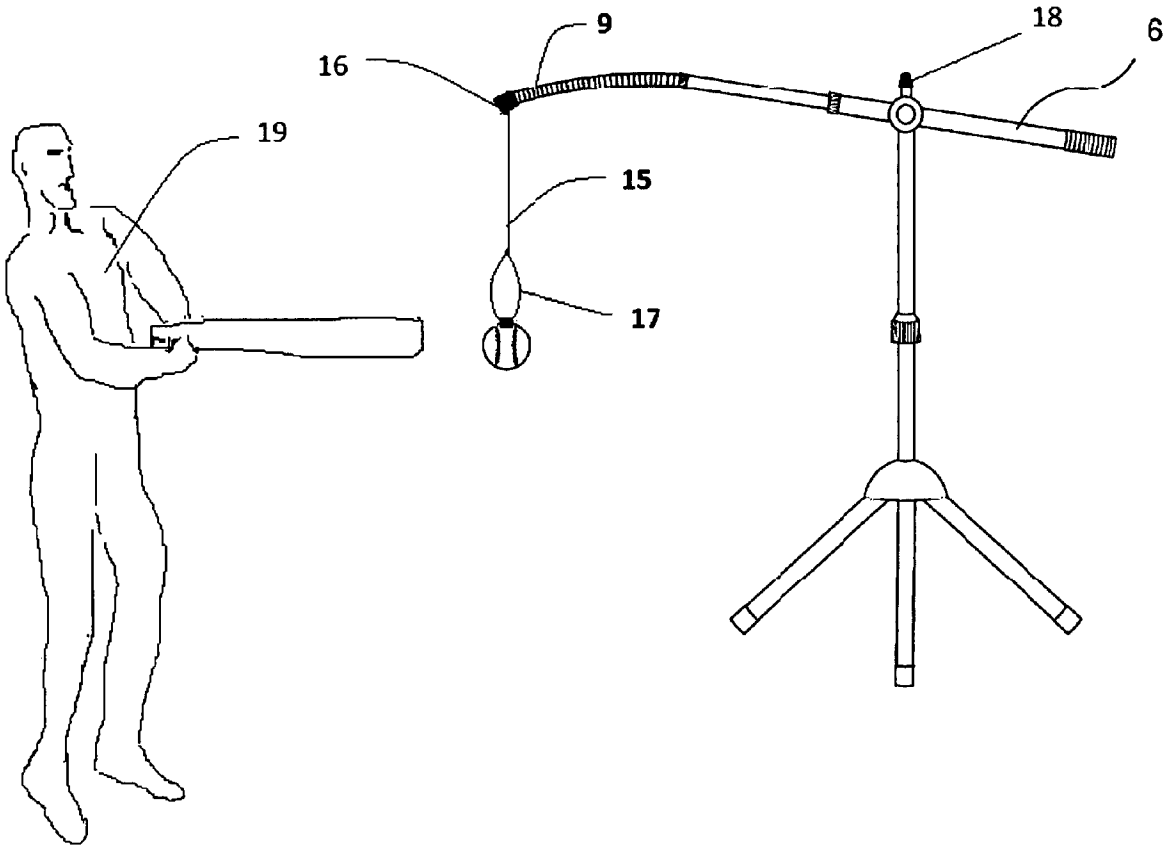
FIG. 3 shows a schematic view of the third embodiment of the present invention.
Figure 3A:
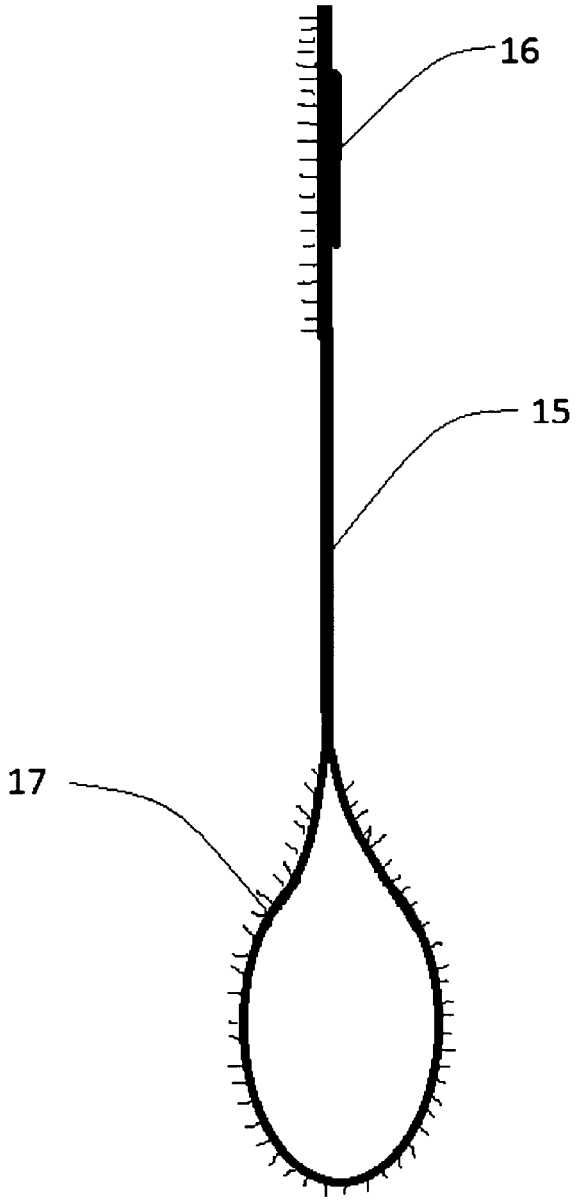

Supporting rod 3 is fixed to base 2. The three supporting legs 1 are contacted to base 2 and can be folded for storage after use. By loosing joint 4, the support rod can be adjusted to different heights and rotated along vertical axis. The hanging arm 6 can be adjusted in length by joint 8. It connected with support rod 3 by joint 7. The hanging arm can be adjusted in different angle and rotated by adjusting joint 7. It can be easily detached from the support rod 3 to become a handheld hitting training apparatus as shown in FIG. 3 where trainer can hold the apparatus by handle 5.

The adjustable extension arm 9 is made from the flexible tube with gooseneck like structure connecting with hanging arm 6 by screw. It can be easily adjust in any angles and directions from which change the position of the hanging ball. The attaching rods 11 and ball 13 can be connected by attaching part such as hook/loop, magnets or adhesive 12. The connection is releasable when impacted by an outside element such as swing bat. The number of attaching rods used can be determined by batter's hitting skills. The attaching mechanical hook 10 can be replaced by hook/loop, magnet or adhesive 12 if no attaching rod, or string used as shown in FIG. 3.

Figure 2:
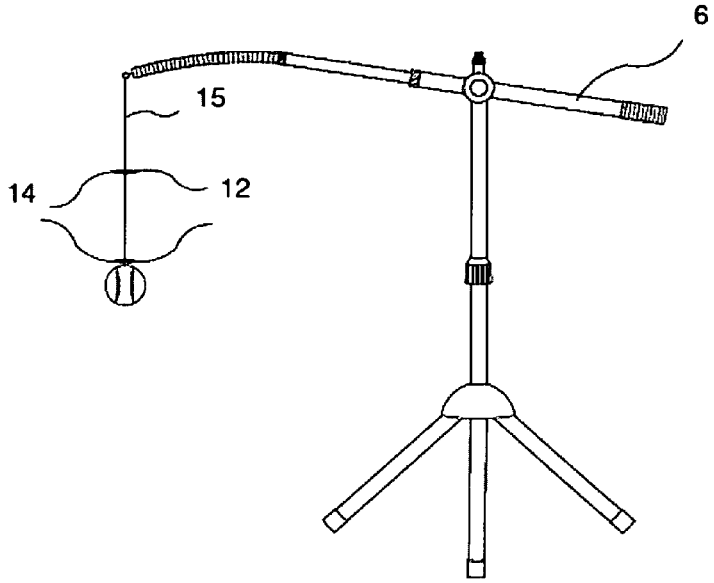
FIG. 2 shows a schematic view of the second embodiment of the present invention.

FIG. 2 shows a schematic view of the present invention with two attaching strings/strips 15 with connect part 14 and attaching part hook/loop, magnet or adhesive 12 and hanging arm 6 with different angle.

Figure 2A:
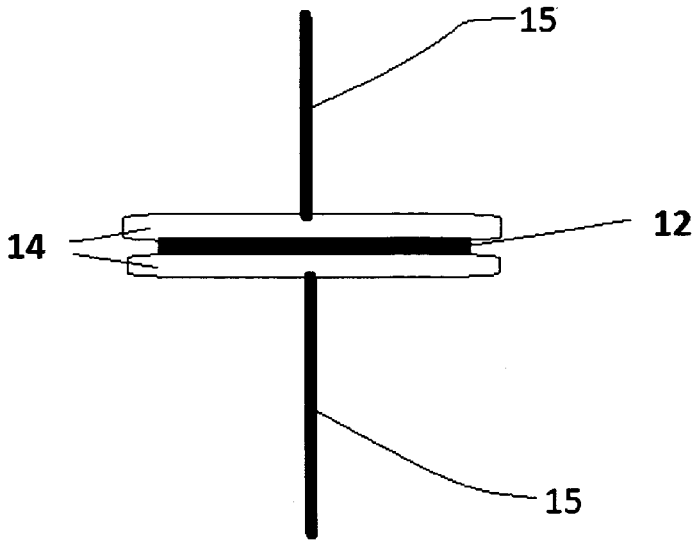
FIG. 2*a*-2*d* shows a schematic views of the exampled of attaching parts.

FIG. 2*a* is a closer view of the strings/strips 15 connect part 14 and attaching part 12, which can be hook/loop, magnet or adhesive.

Figure 2B:
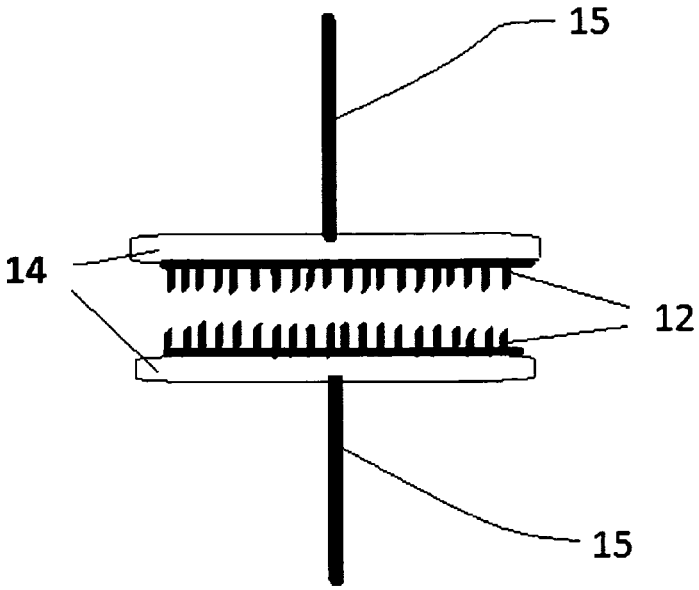

FIG. 2*b* shows an attaching part made from fiber brush structure with special polymer coating. When two side of rubber coated brush pushed together, the adhesion and friction force can hold the weight of connection parts and ball for batting practice.

Figure 2C:
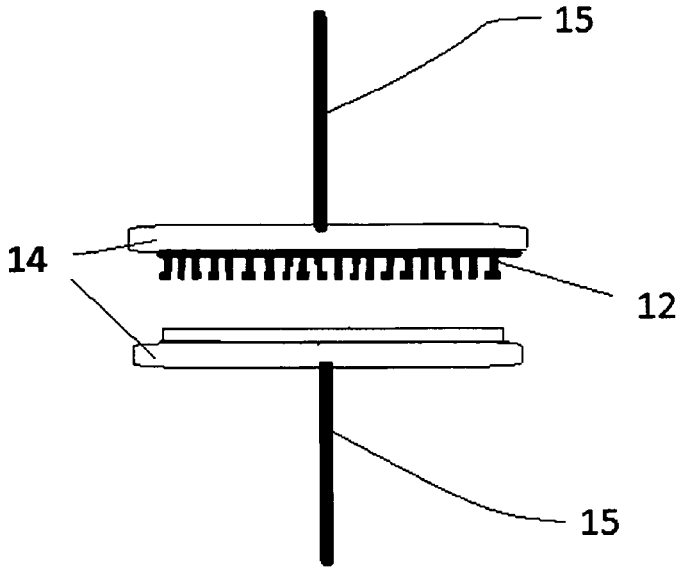
Figure 2D:
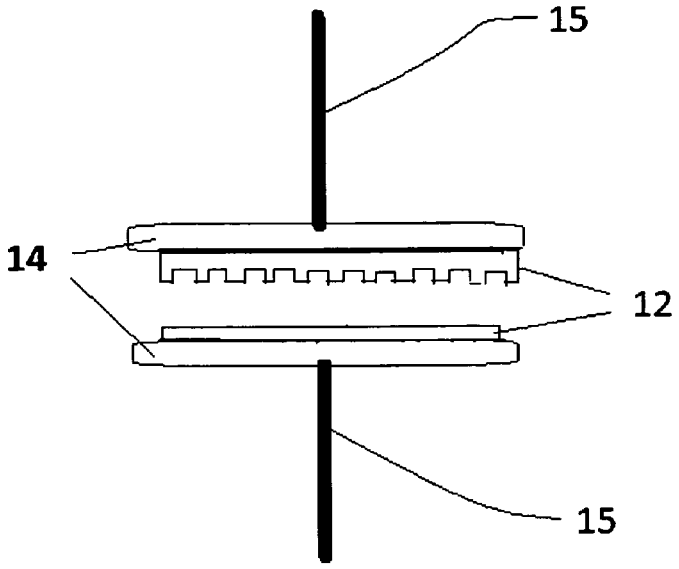

FIG. 2*c* shows an attaching part made from fiber brush with soft flat tip structure. FIG. 2*d* shows a rubber plate with tiny dips in surface. Similar as Gecko's feet, both structures can provide enough adhesion to the connection part 14 and work as attaching part 12. These structures as well as the polymer coating shown in FIG. 2*b* can be made from polymer materials such as silicone, polyurethane, thermal plastic elastomer, rubber type materials with proper modules and good viscoelastic properties.

FIG. 3 shows a schematic view of the present invention with the hanging arm detached from the support rod 3 and holding the ball by attaching part 12 without using attaching rod 11 or string 15. It becomes a hand held hitting training apparatus.

Figure 4:
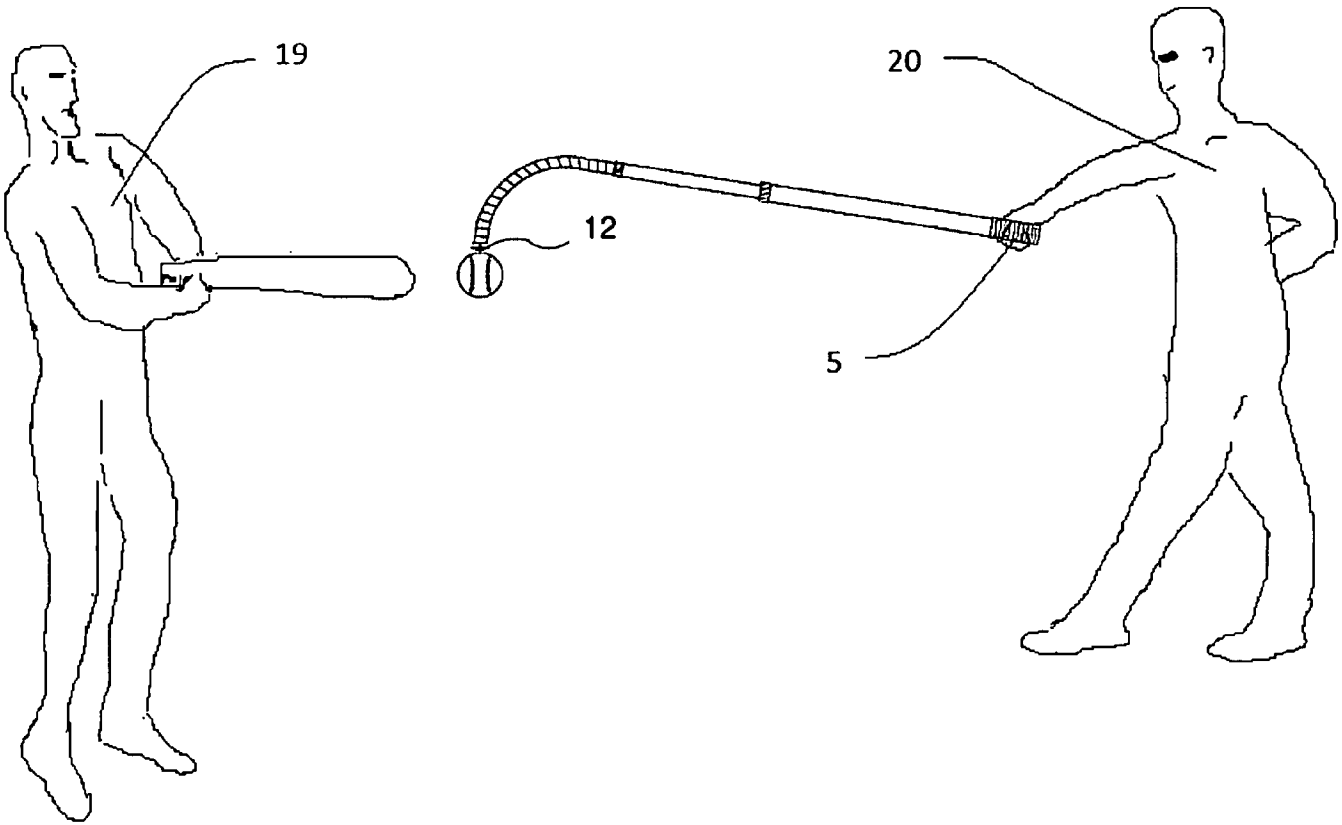
FIG. 4 shows a schematic view of the third embodiment of the present invention.
Figure 4A:
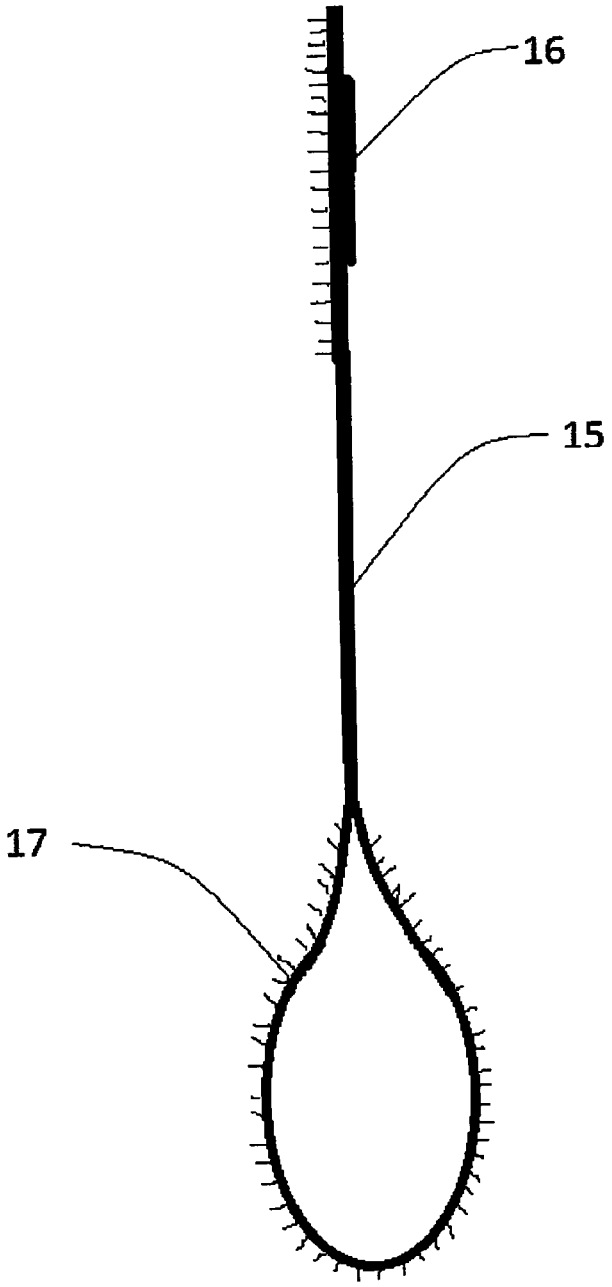
FIG. 4*a* shows a schematic view of a loop attachment part.

FIG. 4 shows a schematic view of the present invention with a loop attaching part. FIG. 4*a* shows the details of the loop attaching part which including a loop hook 17 at bottom, string/strip 15 in the middle and hook with loop backing 16 on the top. By wrapping part 16 around extension arm 9, the loop attaching part can attaching the ball for batting practice. FIG. 4 also shows a standard ¼"-20 or ⅜"-16 screw 18 at the top end of support rod for removable attachment to other devices such as a camera, a video camera, a speed gun, and a lighting element.

The hitting apparatus described in current invention can be used not only for training of hitting baseball but also for hitting softball, waffle ball, tennis ball or the like.

Above-described preferred embodiments of the present invention are illustrative only and not limiting. Various substitutions and modifications have been suggested in the foregoing descriptions. It will be apparent to those skilled in the art that various changes and modifications may be made without departing from this invention in its broader aspects.

What is claimed is:

1. A training apparatus comprising:

a support base;

a height adjustable support rot having a proximal end and a distal end, wherein the distal end of the support rod is attached to the support base;

an adjustable, extendable support arm having a first end and a second end detachably connected to the proximal end of the support rod;

a flexible extension arm having a first end and a second end, the first end of the extension arm fixedly attached to the second end of the support arm; and a connection element having a first end attached to the second end of the extension arm and a second end attached to an attaching element, wherein the attaching element releasably connects a ball to the second end of the connection element, and wherein the training apparatus allows for a first mode of operation by a user where the support arm is connected to the support rod and a second mode of operation where the support arm is held by a user; and wherein the flexible extension arm is capable of 360 degree rotation when a user impacts the ball with a hitting implement.

2. The training apparatus as in claim 1, wherein said support arm is a gooseneck.

3. The training apparatus as in claim 1, wherein the attaching element is selected from the group consisting of adhesive, magnet, hook-and-loop material and rubber.

4. The training apparatus as in claim 3, wherein the connecting element is selected from the group consisting of a rod, plurality of strips and strings.

5. The training apparatus as in claim 3, wherein the attaching element comprising a fiber brush structure with a special polymer material.

6. The training apparatus as in claim 3, wherein said attaching element comprising a pressure sensitive adhesive or Gecko type adhesive which aids in attaching a ball with minimum detaching force.

7. The Training apparatus as in claim 1, wherein said height adjustable support rod includes an attachment screw at the upper end for the removable attachment of alternative devices selected from the group consisting of a camera, a video camera, a speed gun and a lighting element.

* * * * *

UNITED STATES PATENT AND TRADEMARK OFFICE

CERTIFICATE OF CORRECTION

PATENT NO. : 8,900,075 B2
APPLICATION NO. : 12/932903
DATED : December 2, 2014
INVENTOR(S) : Gu et al.

It is certified that error appears in the above-identified patent and that said Letters Patent is hereby corrected as shown below:

Title Page, Item (75) Inventors should read:

--Fan Gu, Houston, TX (US); Kevin J. Gu, Houston, TX (US); Brett J. Gu, Houston, TX (US)--.

Signed and Sealed this
Third Day of March, 2015

Michelle K. Lee

Michelle K. Lee
*Deputy Director of the United States Patent and Trademark Office*